US005496609A

United States Patent [19]

Michelstein

[11] Patent Number: 5,496,609

[45] Date of Patent: Mar. 5, 1996

[54] PROTECTIVE BUMPER

[76] Inventor: Susan L. Michelstein, 321 Willow Springs, New Milford, Conn. 06776

[21] Appl. No.: 265,760

[22] Filed: Jun. 27, 1994

[51] Int. Cl.[6] ..... B32B 1/06

[52] U.S. Cl. ..... 428/71; 248/345.1; 108/27; 52/717.03; 52/717.04; 52/717.05; 52/287.1; 428/31; 428/40

[58] Field of Search ..... 428/36.5, 71, 31, 428/40; 248/345.1; 52/717.03, 717.04, 717.05, 287.1; 108/27

[56] References Cited

U.S. PATENT DOCUMENTS

| | | | |
|---|---|---|---|
| 4,072,231 | 2/1978 | Helms | 206/453 |
| 4,277,526 | 7/1981 | Jackson | 428/31 |
| 4,999,233 | 3/1991 | Probst et al. | 428/122 |
| 5,060,902 | 10/1991 | Hartman | 248/345.1 |
| 5,065,972 | 11/1991 | Buckshaw et al. | 248/345.1 |
| 5,149,575 | 9/1992 | Soifer | 428/188 |

*Primary Examiner*—Alexander S. Thomas
*Attorney, Agent, or Firm*—Henry S. Miller; Rhodes & Ascolillo

[57] ABSTRACT

The invention is directed to a bumper to be attached to furniture and the like for protecting persons, in particular children, from injuring themselves on the sharp edges and corners. The bumper is formed of a deformable shell filled with a soft resilient plastic and shaped, in cross section as a modified circle having a planar side which is formed of an adhesive foam. The adhesive is protected by a removeable tape which is discarded as the bumper is affixed to a selected object.

1 Claim, 1 Drawing Sheet

PROTECTIVE BUMPER

BACKGROUND OF THE INVENTION

1. Field of the Invention

This invention relates generally to protective bumpers and more particularly to such bumpers as would be used to protect persons and things from the sharp edges of furniture and the like.

2. Description of the Prior Art

The construction of most furniture purchased today by the average buyer involves the combination of a number of different material. As a practical matter, furniture is almost never what it appears to be. Materials ranging from paper to steel go into making even the simplest of pieces. This invention is concerned with furnishings that contain hard and sharp materials leaving hard and sharp edges. The most notable is the coffee table or end table which is formica or glass covered, also the kitchen table and cabinet corners that protrude at head level for small children. It is not contended that sharp corner of a piece of hard wood would be necessarily less painful upon accidental contact, but the other products seem to leave more of a cutting wound.

A number of U.S. Patents have been issued to inventors seeking to address the same issue particularly with regard to sharp corners. Applicant is unaware of any product that protects sharp edges on both corners and linear edges in as a complete and efficient manner as hers.

An example of the prior art is seen in U.S. Pat. No. 4,072,231 issued Feb. 7, 1978 to Helms who shows a molded corner protector that utilizes the well known air pocket concept for cushion protection. The U.S. Pat. No. 4,999,233 issued Mar. 12, 1991 to Probst et al. discloses a corner protector, again using the air pocket concept with the addition of a simple air pump and valve. U.S. Pat. No. 5,060,902 issued Oct. 29, 1991 to Hartman is a corner protector assembly that includes an inflatable body like balloon fastened to the structure. Another corner protector is seen in U.S. Pat. No. 5,065,972 issued Nov. 19, 1991 to Buckshaw et al. is another form of air cushion corner bumper. The U.S. Pat. to Soifer, No. 5,149,575 issued Sep. 22, 1992 utilizes the open air pocket design for corner protection.

It can be readily seen then that there is a need for an edge protector that is rugged enough to withstand repeated impact and still be flexible enough to attach to linear edges and bend around corners and irregular surfaces.

SUMMARY OF THE INVENTION

The invention is directed to a bumper formed of a soft foam material, encased in a strong but deformable shell and containing an adhesive foam for attachment to a selected surface.

It is therefore an object of the invention to provide a new and improved protective bumper.

It is another object of the invention to provide a new and improved protective bumper that is resilient enough to withstand repeated impact and yet hard enough to resist wear and abrasion.

It is a further object of the invention to provide a new and improved protective bumper that is supple and sufficiently flexible to follow corners and irregular surfaces.

It is still another object of the invention to provide a new and improved protective bumper that is easily attached and removed.

It is still a further object of the invention to provide a new and improved protective bumper that is of durable and reliable construction.

It is another object of the invention to provide a new and improved protective bumper which may be easily and efficiently manufactured and marketed.

These and other advantages, features and objects of the invention will become more apparent from the following description taken in connection with the illustrative embodiment in the accompanying drawings.

DETAILED DESCRIPTION OF THE PREFERRED EMBODIMENT

Figure 1:
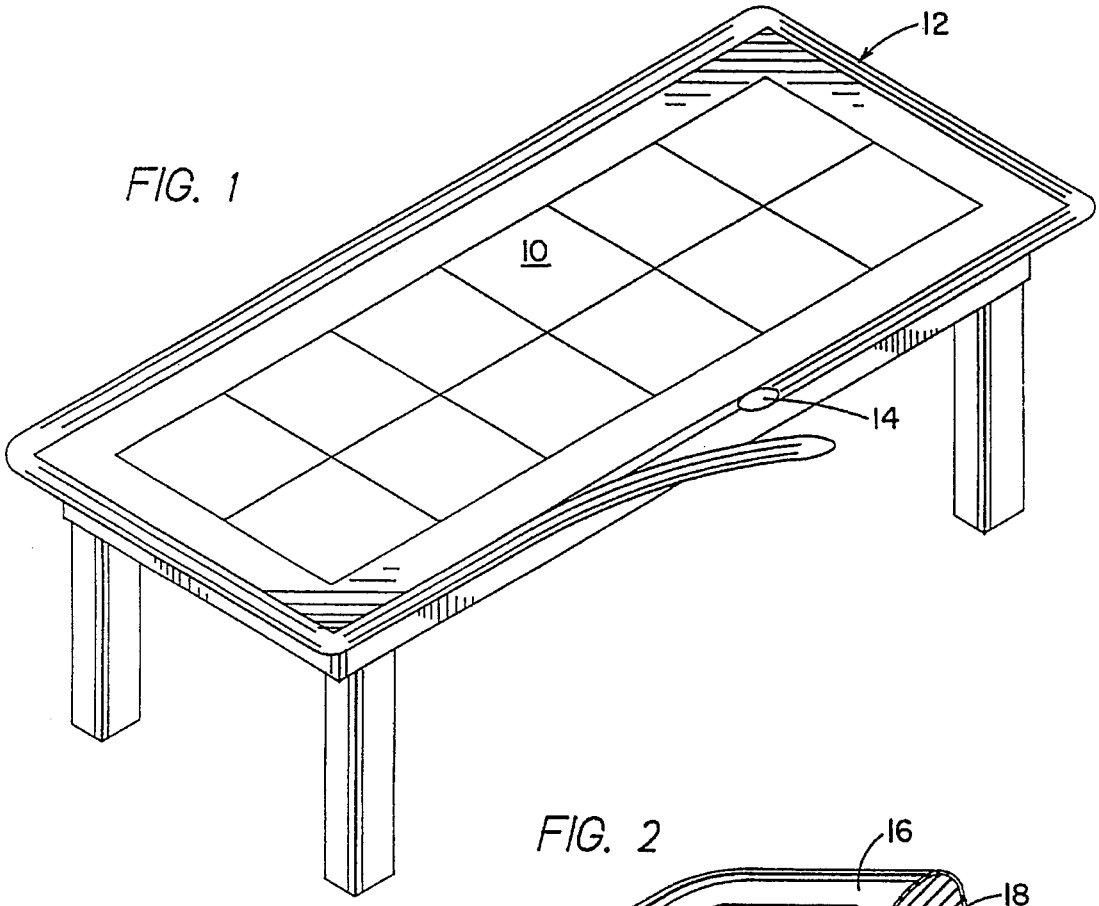
FIG. 1 is a perspective view of the invention applied to the edge of a table.

Referring now to the figures a typical table is shown as 10 in FIG. 1. The bumper of the invention is applied to the edge of the table at 12. Being sufficiently supple the bumper application is begun in the middle of a linear side 14 and is applied around the complete perimeter of the table, corners included, back to the point of the beginning. The nature of the material allows application to concave corners as well as convex.

Figure 2:
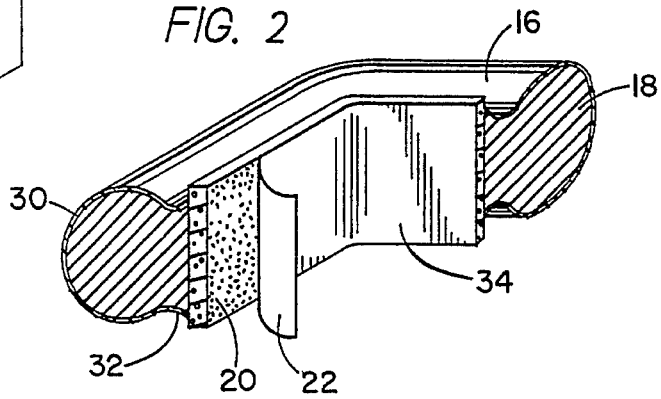
FIG. 2 is an elevation view partly in cross section of the invention.

In FIG. 2, the outer shell 16 formed of a hypoallergenic plastic such as a vinyl or a thin wall poly vinyl chloride, is seen. The shell is readily deformable yet hard enough to resist abuse and abrasion. The shell as shown has a cross sectional shape of a modified circle with one side forming a plane. The modified circle has a circular portion 30, a flared portion 32 and a planar surface 34. This shape enhances the inherent flexibility of the bumper while simultaneously increasing the surface area of planar surface 34. The shell is filled with a soft resilient foam 18 that is light weight and quickly resumes its shape after being compressed by an impact to the shell. The shell is closed on its planar side by a layer of adhesive foam 20 which is protected prior to use by a removable tape 22.

Figure 3:
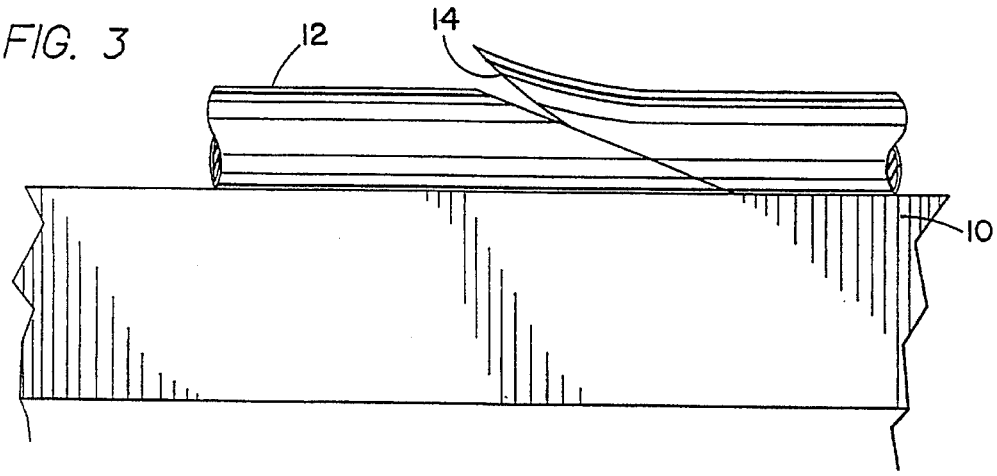
FIG. 3 is a side elevation view showing the invention if applied circumferentially and rejoined.

In use the bumper is envisioned as being supplied by the roll in various convenient lengths. It would be formed in a single molded piece in a conventional extrusion molding process. The bumper is sliced as shown in FIG. 3 and applied to the edge after removal of the protective tape.

The vinyl is easily cleaned and can be manufactured in different colors to match the decor and furniture. When the need for the bumper passes it can be removed and discarded without damaging the paint or the surface.

It should be understood, of course, that the foregoing disclosure relates to only a preferred embodiment of the invention and that numerous modification or alteration may be made therein without departing from the spirit and scope of the invention as set forth in the appended claim.

What is claimed is:

1. A protective bumper for mounting on the corners and edges of household items comprising:

a) an elongated shell of deformable hypoallergenic vinyl plastic having a modified circular cross section, said modified circular cross section further comprising:
a circular portion;
a flared portion; including
a planar face further comprising:

an adhesive foam material for mounting the shell to the household fixture to be protected; and b) a soft, resilient foam filler within the elongated shell.

* * * * *